US006035748A

United States Patent [19]

Burch, Jr.

[11] Patent Number: 6,035,748

[45] Date of Patent: Mar. 14, 2000

[54] FISHERMAN'S PLIERS FOR FISHING SNAP SWIVELS

[76] Inventor: Warren E. Burch, Jr., 1400 Deer Ledge Trail, Cedar Park, Tex. 78613

[21] Appl. No.: 09/172,514

[22] Filed: Oct. 14, 1998

[51] Int. Cl.[7] ..... B25B 1/24

[52] U.S. Cl. ..... 81/426; 81/424.5; 81/426.5; 81/419; 7/106; 7/125

[58] Field of Search ..... 7/106, 125; 81/418, 81/419, 424.5, 426.5, 426

[56] References Cited

U.S. PATENT DOCUMENTS

| | | | |
|---|---|---|---|
| 1,069,106 | 8/1913 | Brice | 81/324 |
| 1,753,080 | 4/1930 | Zwilling et al. | 81/3.6 |
| 2,753,741 | 7/1956 | Riley | 72/409.13 |
| 2,842,997 | 7/1958 | Wentling | 81/418 |
| 3,181,340 | 5/1965 | Gruetzmacher | 72/409.01 |
| 3,597,775 | 8/1971 | McCasland | 7/106 |
| 4,208,749 | 6/1980 | Hermann et al. | 7/106 |
| 4,709,206 | 11/1987 | Edwards et al. | 324/158 |
| 4,796,318 | 1/1989 | Bigej | 7/106 |
| 5,207,012 | 5/1993 | Lael | 43/4 |
| 5,839,141 | 11/1998 | Hermann | 7/106 |

*Primary Examiner*—Timothy V. Eley

[57] ABSTRACT

A pair of fisherman's pliers for opening and closing a fishing snap swivel comprises a pair of pliers with a pair of handles pivotally connected to a pair of jaws such that the jaws are brought together as the handles are brought together. Grooves are in alignment on the opposing jaws for receiving the fishing swivel. When the jaws are completely closed with the snap swivel placed vertically in the grooves, the swivel can be opened or closed by twisting the protruding clasp of swivel to right or left with fingers or by twisting the swivel with the pliers while holding clasp of swivel with fingers, followed by releasing the jaws.

11 Claims, 4 Drawing Sheets

FISHERMAN'S PLIERS FOR FISHING SNAP SWIVELS

BACKGROUND OF THE INVENTION

1. Field of the invention

The present invention generally relates to fisherman's pliers and, in particular, to fisherman's pliers adapted to open and close fishing snap swivels.

2. Description of the Prior Art

In many fishing applications, fishermen use snap swivels which are tied to the fishing line at one end of the swivel. The snap swivel can be opened by applying pressure to and by bending the pin of the swivel until it extends outside of the clasp. The pin is then twisted to either the right or the left until it is positioned to the right or the left of the open end of the clasp. The pin is released and the swivel is open. Due to the resilience of the pin, sufficient space is created between the pin and the clasp upon its release so that fishing line can be placed in the swivel.

A fishing leader, hook, weight, sinker, float, bobber, artificial bait, or other fishing tackle can then be attached to the snap swivel by placing the looped end of fishing line at the end of the leader or the looped end of a hook, sinker, artificial bait or other tackle over the opened pin of the swivel. The swivel is closed by applying pressure to the opened pin until it extends beyond the opening of the clasp and then by twisting it to either the right or the left until it is positioned opposite the open end of the clasp. Pressure on the bent pin is released and the pin springs into position in the clasp, closing the swivel.

One method of opening and closing a fishing snap swivel is by pressing the pin of the swivel between one's fingers until it extends beyond the open end of the clasp. The pin is then twisted to one side with the fingers and released. Since the pin of the swivel is generally stiff in order to provide sufficient resilience for return to the clasp when closing the swivel, this method can cause damage to the fingernails and bruises to the fingers. It is easy to cause damage to the snap swivel by applying excessive force with the fingers to the pin, causing it to lose resilience and to fail to return completely to the clasp. It is an object and advantage of the present invention to provide a means of opening and closing the snap swivel without injuring the fingernails and fingers while avoiding damage to the swivel.

Another method of opening and closing a fishing snap swivel is to place the swivel between the jaws of a pair of fisherman's pliers, needlenose pliers, curved nose pliers, blunt nose pliers, bent nose pliers or other multiple use pliers, and by applying pressure to the pin of the swivel by partially closing the jaws. The pin is then twisted to one side and released from the partially closed jaws. A disadvantage of this method of opening and closing the swivel is the difficulty in applying sufficient pressure to the pin in order to force it outside of the clasp of the swivel while, at the same time, avoiding excessive pressure to the pin which can easily result in overextension and damage to the swivel. Overextension of the pin causes it to lose resilience and to fail to return completely inside of the pin when attempting to close the snap swivel. An advantage of the present invention is the avoidance of overextension and damage to the pin of the swivel.

Use of adjustable vise grip pliers or quick releasable vice-grip pliers requires a very precise adjustment of the degree of closure of the jaws in order to cause sufficient extension of the swivel pin without causing damage to a specific size snap swivel. A change in the adjustment is necessary each time a different size snap swivel is opened or closed. This is a disadvantage because of the tedious and precise adjustment which must be made every time a different size of swivel is used for changing fishing conditions. This tedious adjustment is especially difficult to make when a fisherman, who may be in a rocking boat, is in a hurry to adjust his fishing tackle in the presence of larger or smaller fish. The present invention has the advantage of not requiring an adjustment to the pliers in order to effectively and quickly open snap swivels of varying sizes. The present invention can open and close regular snap swivels and interlock snap swivels.

When the snap swivel is twisted in order to move the pin to the side of the clasp for opening or closing of the swivel or to move the pin directly opposite the opening of the clasp, the swivel tends to easily slip from the fingers or from the jaws of pliers. A further object of the present invention is to hold and secure the snap swivel while twisting the swivel for opening and closing.

The elderly, children and persons with impaired vision especially find it difficult to see and focus on a frequently tiny pin of a snap swivel in order to quickly change their fishing tackle during the excitement resulting from nearby fish. It is an object of the present invention to provide a fisherman's pliers that can quickly open and close the swivel requiring minimal concentration.

U.S. Pat. No. 4,796,318 to Bigej, issued on Jan. 10, 1989, discloses a pair of fisherman's pliers for connecting a lead fishing weight to a fishing line which comprises a pair of pliers with a pair of handles pivotally connected to a pair of elongated and tapered jaws. A wedge is provided for impressing a notch into one end of an elongated piece of lead. The jaws are also provided with depressions for receiving a spherical piece of lead for crimping lead onto a fishing line. The present invention discloses a pair of fisherman's pliers that effectively open and close snap swivels without causing damage to the swivel. The present invention has the further advantage of opening and closing fishing swivels of various sizes, quickly and easily.

U.S. Pat. No. 5,207,012 to Lael, issued on Sep. 2, 1992, discloses a pair of cross jaw pliers with handles for storing and dispensing split shot sinkers and having a recess for seating and retaining a split shot sinker and crimping it on a fishing line. It is an object of the present invention to provide a pair of fisherman's pliers with jaws which receive, open and close a snap swivel.

U.S. Pat. No. 4,889,022 to Peviani, issued on Dec. 26, 1989, discloses a quick releasable vice-grip pliers with an adjustable toggle link releasable by a thumb operable release lever. The pliers provide adjusted engagement of opposed jaws. The present invention has the advantage of not requiring adjustment in order to quickly open and close fishing snap swivels of varying sizes.

Split ring pliers, crimping tools and clamping tools do not provide a means of opening and closing snap swivels with jaws of pliers that have precisely measured depths of grooves specific to the sizes of swivels which enables a fisherman to quickly open and close a snap swivel while effectively avoiding damage to the swivel.

It is a further object of the present invention to provide a pair of fisherman's pliers adapted to opening and closing a snap swivel that is easy to manufacture and economical. Still further objects and advantages will become apparent from a consideration of the ensuing description and drawings.

SUMMARY OF THE INVENTION

The present invention is directed to a pair of fisherman's pliers for opening and closing a fishing snap swivel. The invention comprises a pair of pliers with a pair of handles pivotally connected to a pair of jaws such that the jaws are brought together as the handles are brought together. One or more grooves on each jaw are provided to receive fishing snap swivels. By placing a fishing snap swivel in the grooves, by completely closing the jaws, by twisting the swivel, and then by releasing such jaws, sufficient pressure is provided to open or close a snap swivel and without causing damage to the swivel.

DETAILED DESCRIPTION OF THE PREFERRED EMBODIMENTS

Figure 1:
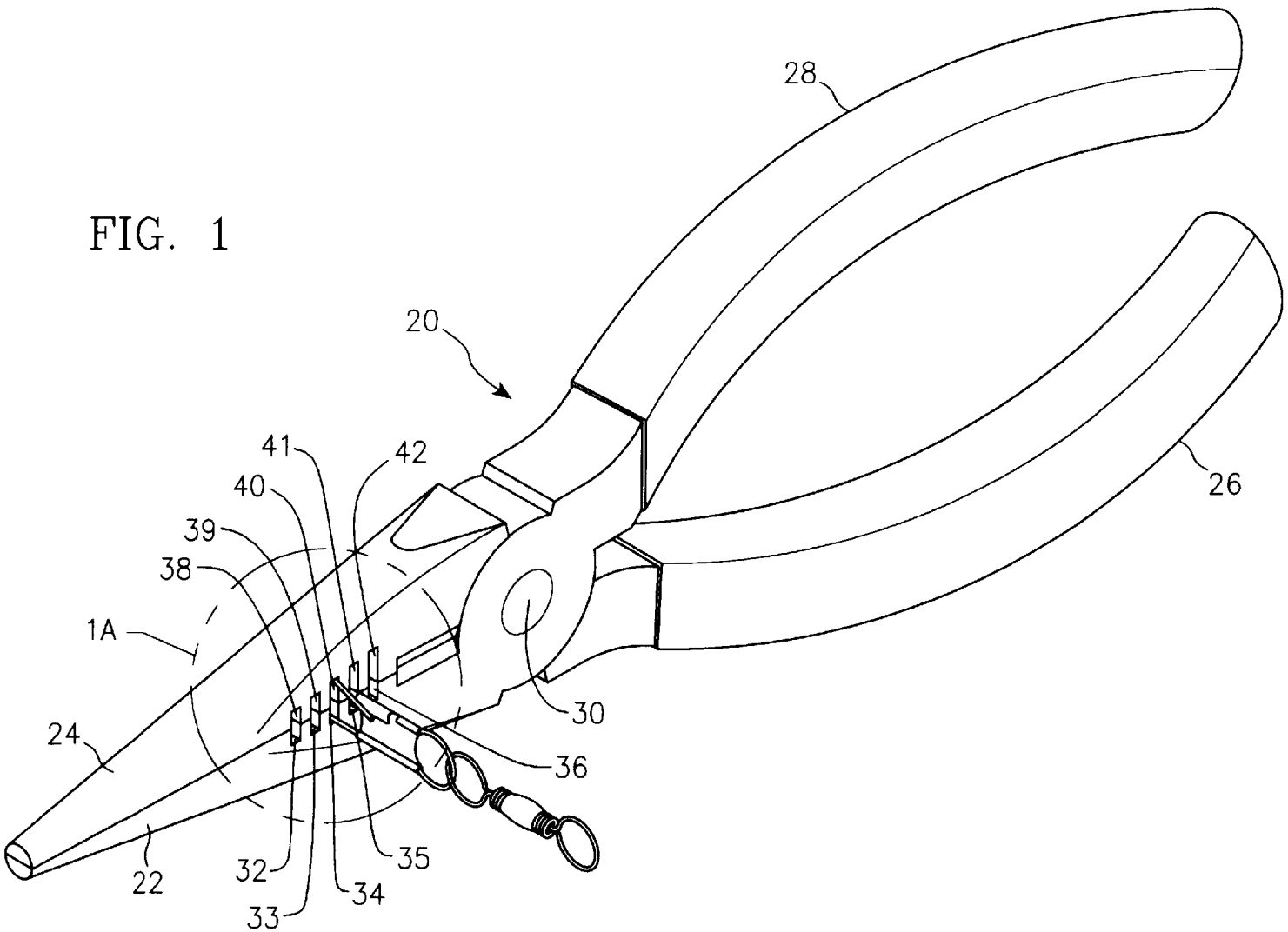
FIG. 1 is a perspective view of a fisherman's pliers in accordance with the present invention showing the grooves and placement of snap swivel for opening and closing of snap swivel.

FIG. 1 shows a perspective view of a pair of fisherman's pliers 20 in accordance with the present invention. The pliers 20 include a pair of jaws 22, 24 pivotally connected to a pair of handles 26, 28 around a pivot pin 30. FIG. 1 shows a pair of needlenose pliers with elongated and tapered jaws 22, 24, although various types of pliers could also be utilized, including regular pliers, curved nose pliers, bent nose pliers, and blunt nose pliers. The jaws 22, 24 are provided with a plurality of grooves 32, 33, 34, 35, 36, 38, 39, 40, 41, 42 having a generally rectangular shape, which extend substantially perpendicular to and on the inner substantially planar surfaces of the jaws for receiving fishing snap swivels. The inner substantially planar surfaces of the jaws are the mating surfaces of the jaws. The grooves open to the mating surfaces of the jaws. The grooves 32, 38 are in alignment, as well as grooves 33, 39 and grooves 34, 40, and grooves 35, 41 and grooves 35, 42 when the pliers 20 are in the closed position and adjoined and extend substantially across the width of jaws 22,24 to the exterior sides of the jaws. The bottom of the grooves is subtantially horizontal to the mating surface of the jaws. The grooves have a width of approximately 1.5 to 3.5 millimeters, a length of approximately 5 to 12 millimeters and a depth of approximately 1 to 6 millimeters. The depth of a groove is the distance it extends away form the generally inner surface of jaws that adjoins when the jaws are closed, described as the mating surface. The grooves open to the mating surface.

It is understood that grooves 32, 33, 34, 35, 36, 38, 39, 40, 41, 42 may extend only partially across width of jaws. By extending grooves only partially across width of jaws, grooves having variations of depth could be placed on both sides of jaws 22, 24 should the need arise for space for a greater number of variations of depth in order to accommodate a larger number of sizes of snap swivels.

Grooves 32, 33, 34, 35, 36 on jaw 22 are of substantially equal depth of approximately 1 to 6 millimeters. The grooves 38, 39, 40, 41, 42 are of increasing predetermined depths of approximately 1 to 6 millimeters generally beginning with the least depth at the narrower portion of the jaw 24.

Table 1 below shows the approximate height of snap swivels according to numbered

TABLE 1

| Swivel size | Height of snap swivel in millimeters |
|---|---|
| 5 | 7 |
| 7 | 5 |
| 10 | 4 |
| *12 | 4 |
| 14 | 3 |

*Size 12 is an interlock snap swivel. The end of the swivel pin of an interlock swivel is generally bent at a 90 degree angle or greater so that the end hooks inside the clasp in order to secure it in the closed position. It is opened and closed in the same manner as a regular swivel.

Table 2 below shows the approximate optimal depths of grooves in millimeters for opening and closing the most commonly used snap swivels. These sizes of snap swivels cover a broad range of fishing tackle needs. Here grooves in jaw 22 remain the same depth of 1.2 millimeters. This results in greater variance of depth of grooves in jaw 24 which further aids a fisherman in selecting the appropriate groove for a given swivel.

TABLE 2

| Swivel size | Goove number and depth | Groove number and depth | Combined depth of grooves |
|---|---|---|---|
| 5 | #36 1.2 | #42 3.8 | 5.0 |
| 7 | #35 1.2 | #41 2.8 | 4.0 |
| 10 | #34 1.2 | #40 2.3 | 3.5 |
| *12 | #33 1.2 | #39 2.3 | 3.5 |
| 14 | #32 1.2 | #38 1.2 | 2.4 |

*Swivel size 12 is an interlock swivel which has a swivel pin with a greater height.

The following Table 3 shows uniform depth of grooves in jaw 22 of 1.4 millimeters. Approximate depths are shown in millimeters. The resulting depths of grooves in jaw 24 are shown for opening and closing commonly used sizes of snap swivels.

TABLE 3

| Swivel size | Groove number and depth | Groove number and depth | Combined depth of grooves |
|---|---|---|---|
| 5 | #36 1.4 | 42 3.6 | 5.0 |
| 7 | #35 1.4 | 41 2.6 | 4.0 |
| 10 | #34 1.4 | 40 2.1 | 3.5 |
| *12 | #33 1.4 | 39 2.1 | 3.5 |
| 14 | #32 1.4 | 38 2.1 | 2.4 |

*12 is an interlock snap swivel.

Table 4 which follows, shows approximate depths of grooves for opening and closing snap swivels of commonly used sizes when the depths are allocated evenly amongst jaws 22,24. The approximate depths are shown in millimeters.

TABLE 4

| Swivel size | Groove number and depth | Groove number and depth | Combined depth of grooves |
|---|---|---|---|
| 5 | #36 2.5 | #42 2.5 | 5.0 |
| 7 | #35 2.0 | #41 2.0 | 4.0 |
| 10 | #34 1.75 | #40 1.75 | 3.5 |

TABLE 4-continued

| Swivel size | Groove number and depth | Groove number and depth | Combined depth of grooves |
|---|---|---|---|
| *12 | #33 1.75 | #39 1.75 | 3.5 |
| 14 | #32 1.2 | #38 1.2 | 2.4 |

*12 is an interlock snap swivel.

The depths of grooves 38, 39, 40, 41, 42 on jaw 24 are important, as well as the combined depths of aligned grooves, because by placing the bottom of a snap swivel shown in FIG. 1 in an appropriate groove 34 in accordance with the size of a swivel 44 on jaw 22, the predetermined depth of groove 40 will cause a swivel pin 46 to extend to a clasp opening 48 of a clasp 50 when jaws 22 an 24 are completely closed without overextending the swivel pin and without causing damage to snap swivel. This provides a method of safely and easily opening and closing swivel since the pin of swivel is bent to the appropriate distance outside of the opening of clasp by simply completely closing opposing jaws so that they are adjoined. The predetermined depth of grooves 38, 39, 40, 41, 42 in order to avoid overextension of the swivel pin is a distinct advantage over prior art since pressure applied to a swivel from the jaws of pliers or from fingers easily causes damage to a swivel by excessively extending the pin beyond the opening of the clasp. The pin then loses resilience and fails to completely spring back and close in the clasp. Pressing swivel with fingers can damage fingernails and cause bruises on the end of the finger. It is difficult to control the degree of pressure applied against swivel with fingers and with pliers that have a generally planar surface on the inner side of opposing jaws.

Depth of grooves 32, 33, 34, 35, 36 has advantage of holding snap swivel during twisting motion to open or close swivel. Preferably, equal depth on one opposing jaw shows the appropriate groove in which to place swivel of a specific size since the greater resulting variations on the opposite jaw are then highly visible on side of jaw, making it easy for a fisherman to quickly choose the appropriate corresponding grooves in which to place swivel in accordance with the size of swivel he is using. It is understood that grooves having variations in depth on both jaws may also be placed on pliers, especially when tapered jaws are narrow, requiring variations of depth on both jaws in order to accommodate the size of snap swivel without adversely affecting the strength of jaws.

Figure 1A:
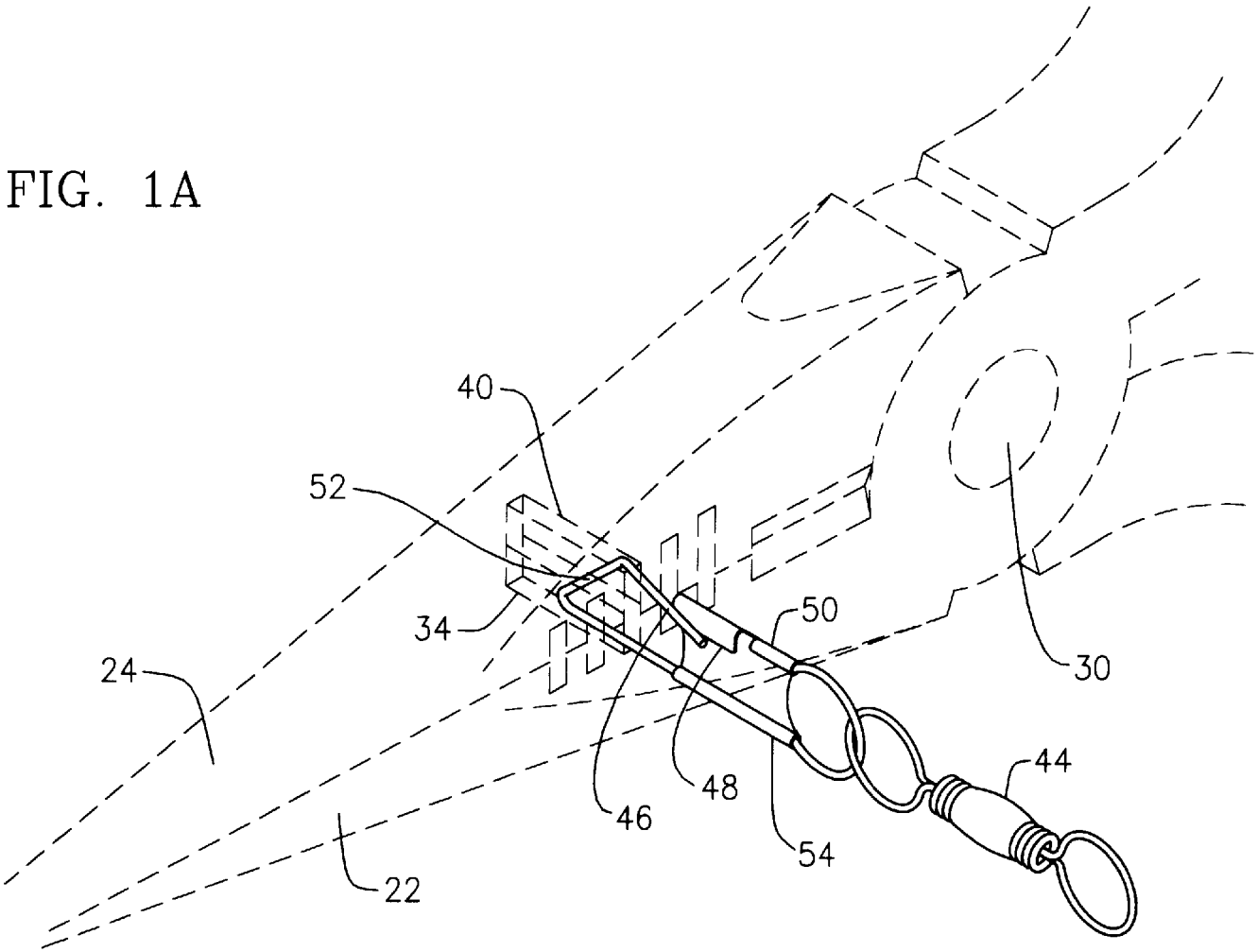
FIG. 1A is a magnified detail perspective view of the pliers and grooves showing the jaws in a closed position with a snap swivel being opened or closed.

Referring now to FIG. 1A, choosing the appropriate groove for opening or closing a snap swivel can be accomplished by comparing size of swivel by placing a swivel end 52 of swivel 44 near grooves 34,40 and other grooves while jaws are in closed position. Grooves 34,40 are shown extending across the mating surfaces of jaws 22,24 from the exterior side surfaces of the jaws to the opposite exterior side surfaces. Swivel 44 can be placed in either side of jaws 22,24.

As shown in FIG. 1A, swivel 44 is opened by opening jaws 22, 24 and placement of swivel in groove 34 in vertical position by holding clasp 50 with fingers which is left outside of and protrudes from the side of jaws 22 and 24. Jaws 22, 24 are completely closed and adjoined. As shown in FIG. 1A swivel pin 46 is then inside of groove 34 and extended outside of clasp opening 48. By twisting clasp end 54 of swivel 44 with fingers or by twisting swivel 44 with pliers while holding clasp end 54 with fingers, so that pin 46 is no longer aligned under clasp 50 and by releasing jaws beyond clasp opening 48, swivel 44 is opened.

Swivel 44 is also opened by comparing the size swivel to the combined depths of grooves on side of jaws 22,24 when jaws are in closed position. After choosing the appropriate grooves, hold clasp 50 of swivel 44 with fingers and merely press swivel end 52 inside of grooves with fingers when jaws 22,24 are in the closed position. Pin 46 is then forced outside of clasp opening 48. By twisting clasp end 54 of swivel 44 with fingers or by twisting swivel 44 with pliers 20 while holding clasp end 54 with fingers, so that pin 46 is no longer aligned under clasp 50 and by removing swivel 44 from closed jaws either by pulling swivel from side of jaws 22,24 or by releasing jaws, swivel 44 is opened.

Swivel 44 is closed by opening jaws 22, 24, placement of bottom portion of swivel 44 in groove 34 and completely closing and adjoining jaws 22, 24 against vertically positioned open swivel while clasp 50 is held with fingers. Pin 46 is then inside of groove 40 and extended outside of clasp opening 48. Clasp 50 protrudes from the side of jaws 22, 24. By twisting clasp end 54 of swivel with fingers or by twisting swivel with pliers 20 while holding clasp end 54 with fingers, so that pin 46 is aligned under clasp opening 48 and by releasing jaws 22, 24, pin 46 springs inside of clasp 50. Snap swivel 44 is closed.

Swivel 44 is also closed by merely pressing swivel end 52 inside of appropriately chosen grooves according to size of swivel when jaws 22,24 are in closed position with fingers. Pin 46 is then inside of groove and extended outside of clasp opening 48. Clasp 50 protrudes from the side of jaws 22,24. By twisting clasp end 54 of swivel with fingers or by twisting swivel with pliers 20 while holding clasp end 54 with fingers, so that pin 46 is aligned under clasp opening 48 and by continuing to hold clasp 50 with fingers and by removing swivel with fingers from jaws 22,24 or by releasing jaws 22,24, pin 46 springs into clasp opening 48 and inside of clasp 50. Snap swivel is closed.

It is difficult to apply sufficient pressure with the jaws of pliers in order to hold the snap swivel in place while twisting the clasp and at the same time avoid damage to the swivel when using pliers that have jaws with planar inner surfaces. Small snap swivels are especially easy to damage with the jaws of pliers and with the fingers because of the narrowness of the swivel pin. Loss of resilience of swivel pin caused by overextension results in failure to spring into or outside of clasp when attempting to open or close swivel. The present invention has the advantage of holding and securing swivel 44 during the twisting motion required to open and close the swivel, while at the same time, avoiding excessive pressure applied to pin 46.

Pliers FIG. 1 shown in the drawings are approximately 6 inches long and provide a convenient and very workable device for use by most men which opens and closes common sizes of swivels. It will be understood, however, that pliers FIG. 1 can be made smaller for use by women or children or larger if needed. Larger pliers such as those that are approximately 8 inches long provide additional space for more grooves should even more grooves be desirable to facilitate opening and closing a greater number of sizes of swivels.

Figure 3:
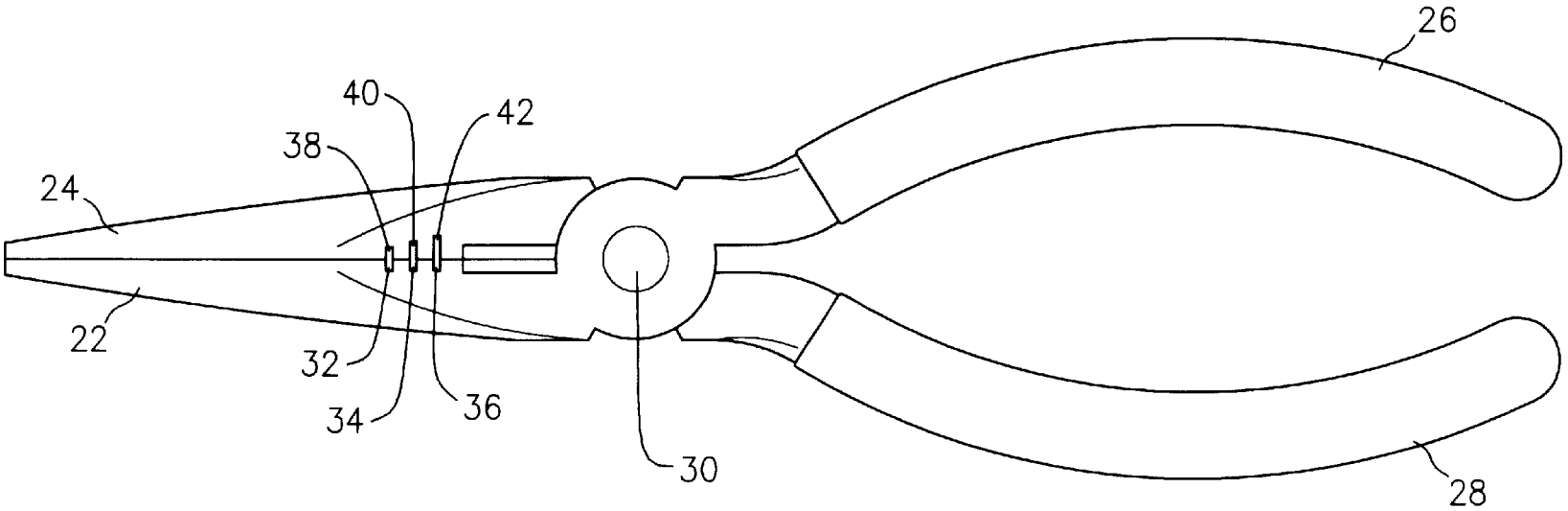
FIG. 3 is a side view of fisherman's pliers showing the grooves on the side of the jaws with the jaws in a closed position.

Referring now to FIG. 3, a side view of pliers, shows a plurality of grooves, 32, 34, 36, 38, 40, 42, on the exterior side surfaces of jaws 22,24. The grooves extend across the mating surfaces of the jaws to the opposite exterior side surfaces. A swivel can be placed in the jaws from either side of the pliers.

Alternate Embodiment Blunt Nose Pliers

Figure 2:
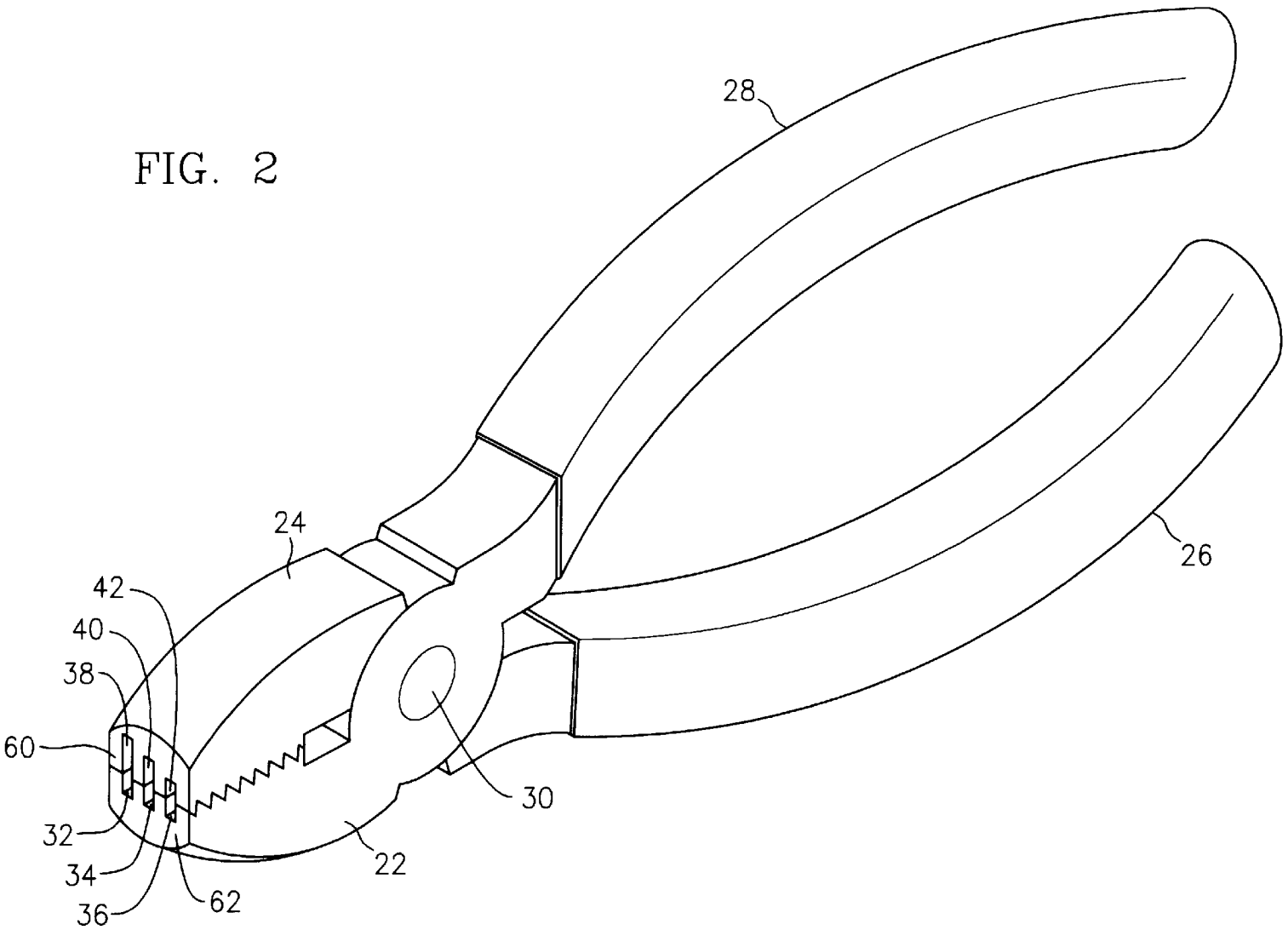
FIG. 2 is a perspective view of blunt nose fisherman's pliers showing grooves extending to the end of jaws.

Referring now to FIG. 2 which is a perspective view of blunt nose pliers for opening and closing a fishing snap swivel. Although FIG. 2 shows a pair of blunt nose pliers, it is understood that the pliers may also be regular pliers, curved nose pliers and bent nose pliers. The pliers include a pair of jaws 22 and 24 pivotally connected to a pair of handles 26 and 28 around a pivot pin 30.

Terminal end 60 has a substantially planar surface 62 with a plurality of substantially rectangular grooves 32, 34, 36, 38, 40, 42 in the jaws, each groove having a depth from the inner surface of the jaws, described as the mating surface, of approximately 1 to 5 millimeter, a width of approximately 1.5 to 3 millimeters, and a length of approximately 4 to 10 millimeters. Grooves 32 and 38 are in alignment when pliers are in the closed position and adjoined. Grooves 32, 34, 36, 38, 40, 42 extend from terminal end 60 approximately 4 to 10 millimeters in order to hold the portion of fishing snap swivel in a vertical position, excluding the clasp 50 shown in FIG. 1 and FIG. 1A. Pairs of aligned grooves of varying predetermined depths are provided to hold, open and close various sizes of swivels.

The predetermined depth of grooves 32 and 38 and other aligned grooves 34 and 40 and grooves 36 and 42 on the inner generally planar surfaces of jaws 22 and 24 is a distinct advantage over prior art since the complete closing and adjoining of jaws will press pin of swivel beyond opening of clasp so that snap swivel may be easily opened and closed by a fisherman without causing damage to swivel. Excessive pressure on pin of swivel causes loss of resilience of pin so that it fails to hook in clasp when pin is released.

Small snap swivels are especially vulnerable to damage since the more precise degree of pressure required in order to press pin beyond clasp and at the same time, avoid damage to swivel, is difficult to apply with pliers that do not have the advantage of the features of the present invention. Small swivels are difficult to hold and twist while simultaneously holding pin outside clasp for opening and closing of swivel by using only the fingers. For very large swivels which do not damage easily, placement in a groove to secure swivel, squeezing jaws partially closed to press swivel pin beyond clasp opening, twisting clasp end, and releasing jaws, will open and close swivel.

Once pin is pressed outside opening of clasp by means of adjoining jaws of needle nose pliers, regular pliers, blunt nose pliers, curved nose pliers or bent nose pliers, a twist of clasp with fingers so that pin is no longer under clasp or so that pin is instead directly under clasp which protrudes from terminal end 60 and release of the pliers will open or close snap swivel, respectively. Both regular snap swivels and interlock snap swivels can be opened and closed.

Those skilled in the art will appreciate the importance and ease of rapidly opening and closing swivels with minimal concentration and without the worry of causing damage to swivel when quickly changing a leader, fishing lure, bobber, weight or other fishing tackle during the course of rapidly responding to fish. The present invention is a distinct advantage for fishermen who participate in competitive fishing events because of the speed with which tackle can be changed. Women and children will especially appreciate the avoidance of damaged fingernails and bruises on their fingers. Elderly fishermen and those with impaired vision will enjoy the ease of preparing or changing tackle without the need of focusing on the slender pin which must be placed in or removed from the frequently tiny clasp of a snap swivel.

By providing the feature of a plurality of grooves, swivels of one or more sizes can be opened and closed, further aiding the fisherman in quickly adapting to potential fish of different size since larger or smaller tackle can be handled by simply choosing the groove which corresponds to the size of the snap swivel.

The present invention has a further advantage in not requiring adjustment of a mechanism which determines the degree of closure of the jaws as required should vice-grip pliers be used when changing and using snap swivels of varying sizes.

A further advantage of the present invention is the low cost of manufacture. The manufacture merely consists of the creation of grooves of predetermined depths aligned on closed jaws of a possible variety of pliers. The preferred method of manufacture would be by including the feature of grooves in the mold utilized for manufacture. Inclusion of grooves results in use of even less material. Alternatively, grooves could be cut in fisherman's pliers. Those skilled in the art will appreciate the significant benefits derived from the instant features, especially when compared to the low cost and ease of manufacture.

In view of the above, it will be seen that the objects of the invention are achieved. Although preferred embodiments of the present invention have been shown, it is obvious that many modifications and variations of the present invention are possible in light of the above teachings. It is therefore to be understood that the present invention may be practiced otherwise than as specifically described

What is claimed is:

1. A pair of fisherman's pliers adapted for opening and closing a fishing snap swivel, the pliers comprising two jaws, each jaw having a mating surface, the jaws being pivotally attached wherein the mating surface of the first jaw is substantially aligned with the mating surface of the second jaw, each jaw having a first exterior side surface and a second exterior side surface and at least one groove means in at least one jaw having a predetermined depth between approximately 1 to 6 millimeters thereby providing space for said at least one groove means in at least one jaw to compress a pin of said fishing snap swivel a predetermined distance without overextending the pin and without causing damage to the pin, said predetermined distance being beyond the opening of a clasp of said fishing snap swivel upon closing the jaws and said at least one groove means having a predetermined width between approximately 1.5 to 3.5 millimeters, said predetermined width of said at least one groove means thereby providing space for the pin of said fishing snap swivel to move to the side of the clasp of the fishing snap swivel when the fishing snap swivel is twisted but prevent pivotal movement of the pin that results in decompression of the pin beyond an opening of the clasp of the fishing snap swivel upon receiving a fishing snap swivel, and wherein a groove means is in at least the first exterior side surface of the first jaw and is substantially perpendicular to the mating surface of said first jaw and opens to the mating surface of said first jaw.

2. The pliers of claim 1 wherein at least one groove means is in the first exterior side surface of the first jaw and at least one groove means is in the second exterior side surface of the first jaw.

3. The pliers of claim 1 wherein at least one groove means is in the first exterior side surface of the first jaw and at least one groove means is in the first exterior side surface of the second jaw.

4. The pliers of claim 1 wherein at least one groove means is in the first exterior side surface of the first jaw and at least one groove means is in the second exterior side surface of the first jaw and at least one groove means is in the first exterior side surface of the second jaw.

5. The pliers of claim 1 wherein at least one groove means is in the first exterior side surface of the first jaw and at least one groove means is in the second exterior side surface of the first jaw and at least one groove means is in the first exterior side surface of the second jaw and at least one groove means is in the second exterior side surface of the second jaw.

6. The pliers of claim 1 wherein at least one groove means in the first exterior side surface of the first jaw is aligned with at least one groove means in the exterior side surface of the second jaw.

7. The pliers of claim 1 wherein at least one groove means in the first and second exterior side surface of the first jaw is aligned with at least one groove means in the first and second exterior side surface of the second jaw.

8. The pliers of claim 1 wherein at least one groove means in the first jaw extends across the width of the mating surface of the first jaw.

9. The pliers of claim 1 wherein at least one groove means in the first jaw extends across the width of the mating surface of the first jaw and at least one groove means in the second jaw extends across the width of the mating surface of the second jaw.

10. The pliers of claim 1 wherein at least one groove means in the first jaw extends across the width of the mating surface of the first jaw and is aligned with at least one groove means in the second jaw which extends across the width of the mating surface of the second jaw.

11. The pliers of claim 1 wherein at least one groove means is substantially rectangular.

* * * * *